US006059002A

United States Patent [19]

Katami

[11] Patent Number: 6,059,002

[45] Date of Patent: May 9, 2000

[54] APPLICATION TOOL

[75] Inventor: Kazunori Katami, Tsurugashima, Japan

[73] Assignee: Tombow Pencil Co., Ltd., Tokyo, Japan

[21] Appl. No.: 09/122,039

[22] Filed: Jul. 23, 1998

[30] Foreign Application Priority Data

Jul. 23, 1997 [JP] Japan ..... 9-211228

[51] Int. Cl.[7] ..... B32B 35/00

[52] U.S. Cl. ..... 156/541; 156/577; 156/579; 401/208

[58] Field of Search ..... 401/208; 156/541, 156/579, 574, 577

[56] References Cited

U.S. PATENT DOCUMENTS 4,853,074 8/1989 Manusch et al. ..... 156/579
5,346,580 9/1994 Elges et al. ..... 156/579
5,512,128 4/1996 Manusch et al. ..... 156/579
5,759,341 6/1998 Kobayashi ..... 156/579
5,770,007 6/1998 Czech et al. ..... 156/579

*Primary Examiner*—Charles R. Eloshway
*Attorney, Agent, or Firm*—Garrison, Morris & Haight, PLLC

[57] ABSTRACT

An application tool having a container enclosing a replaceable cartridge body, with the cartridge body and container integrally and strongly fixed to each other. A slide plate sliding in a narrow groove of a lock portion pierced in a side surface portion of the application tool container is brought into contact with a supporting portion connecting a cartridge body and a transfer head in such a manner as to freely slide, thereby integrally and strongly fixing the application tool container and the cartridge body. Accordingly, the transfer head is prevented from deflecting during use of the application tool, thereby solving the problem of tape breakage experienced by conventional application tools during transferring and applying a paint. Further, the application tool can be smoothly operated.

8 Claims, 3 Drawing Sheets

APPLICATION TOOL

FIELD

The present invention relates generally to an application tool for applying adhesive or paint to a surface and, more particularly, to an application tool having an internal cartridge body having a transfer head for use in applying the adhesive or paint.

BACKGROUND

Application tools transfer paint by sliding a transfer tape having a paint applied on a surface of the transfer tape while bringing the tape into close contact with the object to receive the paint in order to correct errors. In order to enable extended use and reduce the cost of the application tool, there has been suggested an application tool comprising a cartridge body having a supply reel gear and a take-up reel gear meshed with each other. A supply reel and a take-up reel are coaxially attached to each of the supply reel gear and the take-up reel gear. The supply reel and the take-up reel respectively supply and take up a transfer tape through a transfer head. The cartridge body is freely replaceable and is provided within an application tool container structured in such a manner as to be freely separated from the container.

However, in the conventional tool mentioned above, since the application tool container and the cartridge body are not integrally fixed to each other, the force applied to the application tool container by the user is not efficiently transmitted to the cartridge body. Accordingly, when the user firmly presses the transfer tape held by the transfer head against the surface of the object to receive the paint, the force transmitted between the application tool container and the cartridge body is dampened. Therefore, the transfer of the paint attached on the surface of the transfer tape may not be effectively achieved via the transfer head.

Further, since the cartridge body and the application tool container having the cartridge body therein are not integrally fixed, the transfer head for holding the transfer tape is easily deflected. Accordingly, when the user applies a force to the application tool during use of the tool, the transfer head and the paint are easily shifted from the direction which is desired by the user. Further, the transfer tape held by the transfer head may be broken while continuously transferring the paint, thereby inconveniencing the user.

SUMMARY

The present invention overcomes the above described problems by providing an application tool having an application tool container and a cartridge body disposed therein, with the cartridge body and container being integrally fixed in such a manner as to make it possible to replace the cartridge body as required.

The application tool container includes two container bodies which are freely separated along an interface between the bodies. The tool further includes a detachable cartridge body located within the container. A slide plate is slidably brought into contact with a supporting portion which connects the cartridge body and the transfer head. End portions of the slide plate project toward the side surfaces of the application tool container. A knob piece which is mounted to each end portion of the slide plate projects through the side surface of the application tool container. A lock portion for receiving the knob piece is defined by an opening in the side surface of the application tool container. In one preferred embodiment, the lock portion comprises a large diameter portion having a diameter larger than that of the knob piece and a narrow groove for guiding the slide plate. The application tool container and the cartridge body are separated by sliding the slide plate with respect to the lock portion and disengaging the knob piece from the lock portion.

The supporting portion which connects the cartridge body and the transfer head is structured such that the end portions of the slide plate project to the side surfaces of the application tool container. The slide plate slides on the supporting portion when the slide plate is fitted into the narrow groove and the transfer head is locked and fixed to the application tool container through the slide plate so as to become rigid. Accordingly, even when the transfer head is closely attached to the surface of the object to receive the paint, and the force is strongly applied to the transfer head so as to transfer the paint on the transfer tape, the transfer head is not deflected. Therefore, the present invention overcomes the problem of breaking the transfer tape so that transfer and application of the paint can be effectively achieved.

Further, since the application tool container is opened by moving the slide plate from the narrow groove to the large diameter portion, the slide plate does not interfere with the use of the application tool. Moreover, since the slide plate and the lock portion of the application tool container are integrally and strongly fixed to each other, the grip force applied to the application tool container by the user is supported not only by the container but also by the cartridge body, even when the user strongly grips the application tool container. Therefore, the deflection of the application tool container is minimized, and the inaccurate transferring and applying operation of the paint due to the deflection of the application tool container can be prevented.

DETAILED DESCRIPTION

Figure 3:
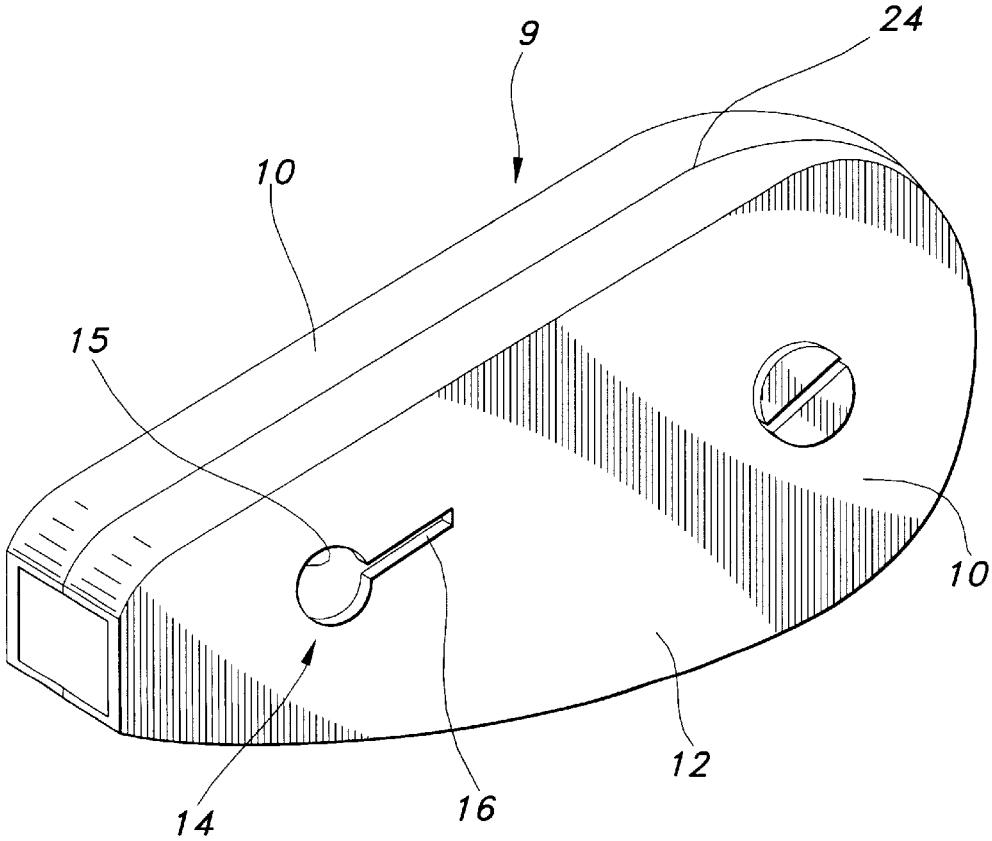
FIG. 3 is an enlarged perspective view illustrating an application tool container in accordance with an embodiment of the present invention.

The invention will be explained below with reference to an embodiment shown in the accompanying drawings. Reference numeral 1 denotes an application tool in accordance with an embodiment of the invention. The application tool 1 includes an application tool container 9 comprising application tool container bodies 10, 10. In an assembled condition, container bodies 10, 10 adjoin each other along an interface designated as 24 in FIG. 3. Bodies 10, 10 may be separated along interface 24 in order to access the interior of the application tool. The application tool 1 has a cartridge body 2 installed detachably in the application tool container 9. The cartridge body 2 comprises a supply reel gear 3 and a take-up reel gear 4 meshed with each other. A supply reel 5 and a take-up reel 6 are coaxially attached to the supply reel gear 3 and the take-up reel gear 4 respectively, for supplying and taking up a transfer tape 8 through a transfer head 7. Typically, the transfer tape 8 includes an adhesive or paint ("paint") applied on one surface of the tape 8.

Figure 1:
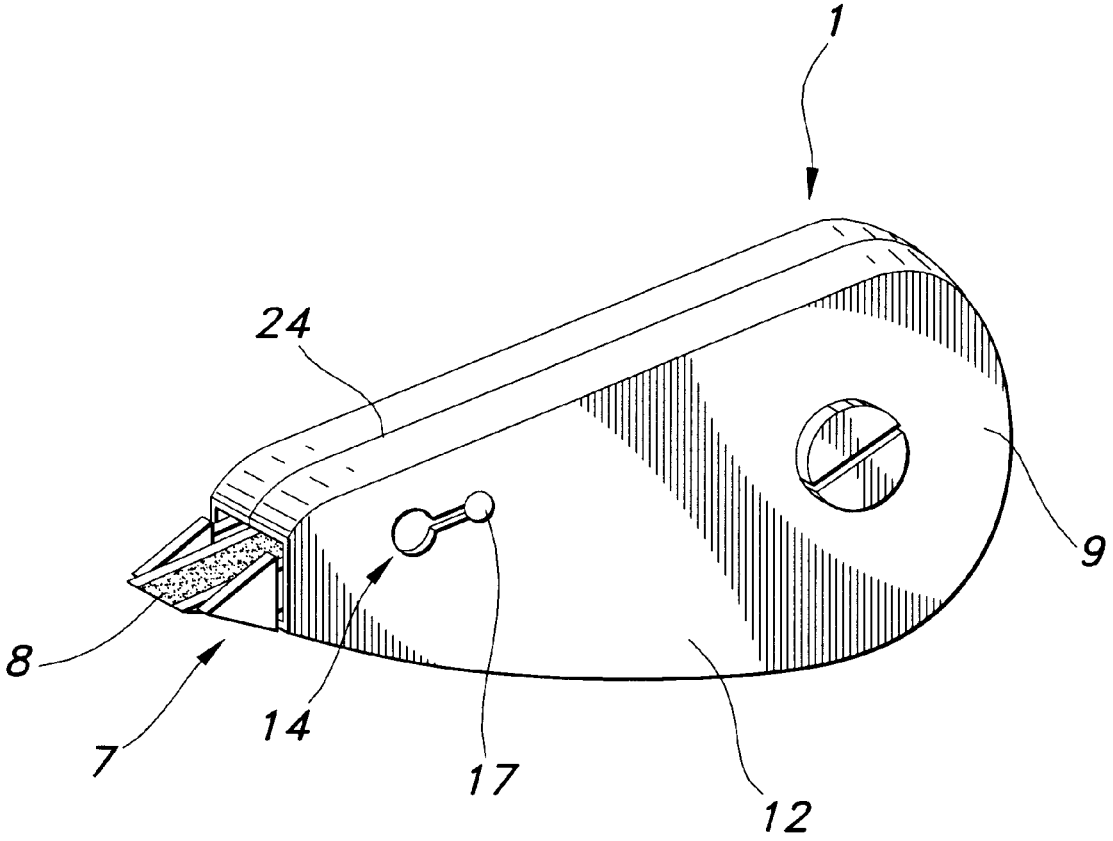
FIG. 1 is a perspective view of an application tool in accordance with an embodiment of the present invention.
Figure 2:
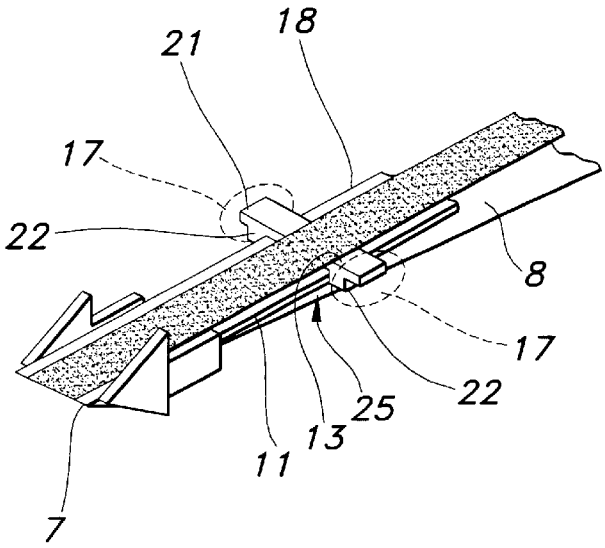
FIG. 2 is an enlarged fragmentary perspective view further illustrating a portion of the application tool shown in FIG. 1.
Figure 4:
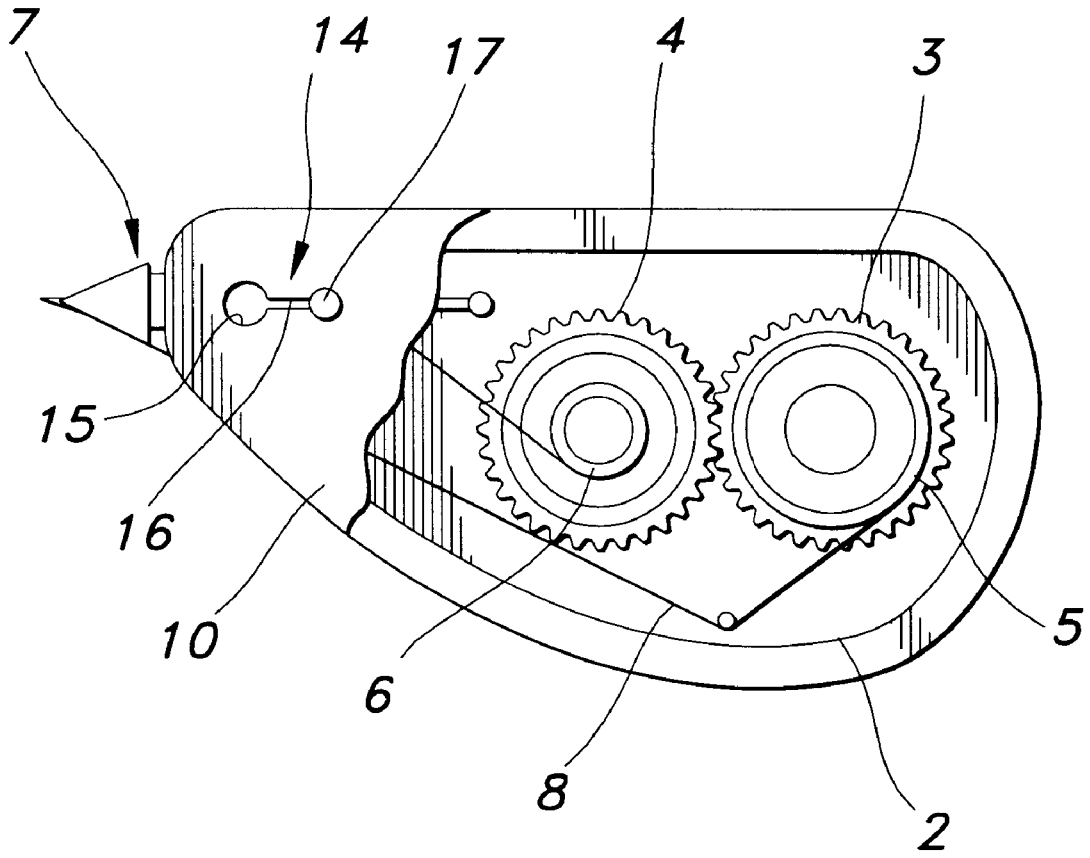
FIG. 4 is a cutaway view further illustrating the application tool shown in FIG. 1.

In accordance with the illustrated embodiment of the present invention, a slide plate 13 is slidably mounted on a supporting portion 18 which connects the cartridge body 2 and a root portion 11 of the transfer head 7. With the cartridge body 2 installed in the application tool container 9, end portions 21 of the slide plate 13 project toward each side surface portion 12 of the application tool container 9. Further, a knob piece 17 (shown in FIGS. 1 and 4) is mounted to each end portion 21 of the slide plate 13. The knob pieces 17 have been depicted generally in phantom in FIG. 2 for clarity of illustrating slide plate 13. A lock portion 14 for receiving the corresponding knobpiece 17 is located on each side surface portion 12 and comprises a large diameter portion 15 having a diameter larger than that of the knob piece 17 and a narrow groove 16 for guiding the slide plate 13. In this structure, the cartridge body 2 and the application tool container 9 can be freely attached to and detached from each other by sliding the slide plate 13 with respect to the lock portion 14.

In use, the slide plate 13 slides on the supporting portion 18 of the transfer head 7. The end portions 21 of the slide plate 13 extend through lock portion 14 of the adjacent side surface portion 12 of the application tool container 9. Each lock portion 14 comprises the large diameter portion 15 having a diameter larger than that of the knob piece 17 and the narrow groove 16 for guiding the slide plate 13. Each of the end portions 21 of the slide plate 13 are held within one of the narrow grooves 16 so that the transfer head 7 is fixed to the application tool container 9 through the slide plate 13. Accordingly, even when a force is strongly applied to the transfer head 7 so as to transfer the paint on the transfer tape 8, the cartridge body 2 having the transfer head 7 and the application tool container 9 are fixed by the engagement of the slide plate 13 and the lock portions 14. Therefore, the transfer head 7 holding the transfer tape 8 is not deflected, thereby solving the problems of conventional application tools with regard to the breaking and curving of the transfer tape 8 due to the deflection of the conventional transfer head.

Further, the application tool container 9 having therein the cartridge body 2 is opened by sliding the slide plate 13 from the narrow groove 16 of the lock portion 14 to the large diameter portion 15. Therefore, the slide plate 13 for opening and closing the application tool container 9 does not disturb the user during use of the application tool 1, thereby permitting a smooth and continuous application of the paint by the application tool 1. The opening and closing operation can be easily performed by sliding the knob pieces 17 of the slide plate 13 along the narrow groove 16 to or from the large diameter portion 15 provided in each of the application tool container bodies 10. Still further, the slide plate 13 may be provided with a pair of tabs 22 which define a groove portion 25 having a width substantially equal to that of the supporting portion 18 of transfer head 7 so that the slide plate 13 can prevent lateral deflection of the transfer head 7.

Preferably, the width of the narrow groove 16 and the thickness of the end portions 21 of the slide plate 13 are substantially equal to each other. Therefore, the narrow groove 16 and the slide plate 13 are closely fitted to each other, thereby securing the slide plate 13 to the supporting portion 18. Therefore, even when the user strongly grips the application tool container 9 during use the grip force of the user applied to the application tool container 9 is supported not only by the application tool container 9 but also by the cartridge body 2 installed within the application tool container 9. Accordingly, the deformation of the application tool container 9 is minimized, so that the inaccurate transferring and applying operation of the paint due to the deformation of the application tool container 9 can be prevented.

As mentioned above, since the application tool container 9 of the application tool 1 and the cartridge body 10 installed in the application tool container 9 are integrally and strongly fixed to each other, the deflection of the transfer head 7 during paint application can be prevented. Therefore, the problems associated with conventional application tools, such as breakage of the transfer tape and inaccurate application of the paint are prevented. Further, during use of the application tool 1 of the present invention, the slide plate 13 does not disturb the user so smooth operation can be achieved. Still further, since the application tool container and the cartridge body installed in the application tool container are integrally and strongly fixed to each other, the strength of the application tool container is improved relative to conventional containers, so that even when the user applies a strong gripping force, the deformation of the application tool container can be prevented, thereby avoiding the aforementioned problems of conventional application tools.

What is claimed is:

1. An application tool for applying paint contained on a transfer tape to a surface of an object, said application tool comprising:

a cartridge body having a supply reel gear meshed with a take-up reel gear, a supply reel coaxially attached to the supply reel gear and a take-up reel coaxially attached to the take-up reel gear;

a transfer head connected to said cartridge body by a supporting portion, said supply reel supplying the transfer tape to said transfer head, said take-up reel taking up the transfer tape after the tape has passed across said transfer head;

an application tool container enclosing said cartridge body, said application tool container having first and second side surface portions, said first side surface portion defining a first lock portion and said second side surface portion defining a second lock portion; and a slide plate slidably mounted on said supporting portion, said slide plate engaging said first and second lock portion thereby preventing excessive deflection of said transfer head.

2. The application tool defined in claim 1 wherein said slide plate further includes a pair of tabs which define a groove portion for sliding the slide plate along the supporting portion of the cartridge body.

3. The application tool defined in claim 2 wherein said groove portion has a width substantially equal to a width of the supporting portion in order to minimize lateral deflection of the transfer head.

4. The application tool as defined in claim 1 wherein said slide plate includes a knob piece on each end of the slide plate.

5. The application tool as defined in claim 4 wherein each said lock portion defines a large diameter portion for receiving the corresponding knob piece of the slide plate.

6. The application tool of claim 5 wherein the lock portion further defines a narrow groove connected to said large diameter portion for engaging said slide plate.

7. The application tool as defined in claim 6 wherein the slide plate has a thickness substantially equal to the width of the groove portion.

8. The application tool as defined in claim 1 wherein the application tool container comprises a pair of container bodies which are separable along an interface between said bodies.

* * * * *